US011030962B2

(12) United States Patent
Lee et al.

(10) Patent No.: US 11,030,962 B2
(45) Date of Patent: Jun. 8, 2021

(54) BACKLIGHT UNIT AND DISPLAY DEVICE

(71) Applicant: LG Display Co., Ltd., Seoul (KR)

(72) Inventors: SungYub Lee, Seoul (KR); YoungJoon Lee, Gyeonggi-do (KR); SeungSeok Oh, Seoul (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/725,022

(22) Filed: Dec. 23, 2019

(65) Prior Publication Data

US 2020/0211481 A1 Jul. 2, 2020

(30) Foreign Application Priority Data

Dec. 26, 2018 (KR) ..... 10-2018-0169352

(51) Int. Cl.
*G09G 3/34* (2006.01)
*G09G 3/36* (2006.01)

(52) U.S. Cl.
CPC ..... *G09G 3/3406* (2013.01); *G09G 3/3648* (2013.01); *G09G 2320/0626* (2013.01)

(58) Field of Classification Search
CPC ..... G09G 3/3648; G09G 2320/0233; G09G 2320/0626; G09G 2320/064; G09G 2360/141; G09G 3/3406; G09G 3/342; G09G 3/3426
See application file for complete search history.

(56) References Cited

U.S. PATENT DOCUMENTS

2002/0067332 A1* 6/2002 Hirakata ..... G09G 3/342 345/102
2009/0109167 A1* 4/2009 Park ..... G09G 3/3426 345/102
2009/0244112 A1* 10/2009 Jung ..... G09G 3/3406 345/691
2010/0302268 A1* 12/2010 Jun ..... G09G 3/3648 345/589
2012/0188217 A1* 7/2012 Hasegawa ..... G09G 3/3406 345/211
2013/0106895 A1* 5/2013 Jeong ..... G09G 3/3406 345/589
2015/0116379 A1* 4/2015 Lim ..... G02F 1/133603 345/691
2017/0047023 A1* 2/2017 Matsui ..... G09G 3/3406
2019/0244572 A1* 8/2019 Le ..... G09G 3/36

* cited by examiner

*Primary Examiner* — Hong Zhou
(74) *Attorney, Agent, or Firm* — Morgan, Lewis & Bockius LLP

(57) ABSTRACT

A backlight unit and a display device are provided. The duty or the like of a light source driving signal is adjusted so that a frequency component causing flicker to be visible, among frequency components of luminance appearing in a driving period of low-speed driving mode. Flicker is prevented or reduced in the low-speed driving mode. The display device is driven in the low-speed driving mode to reduce power consumption. The display device is driven at a lower display driving frequency in the low-speed driving mode, thereby improving the efficiency thereof.

12 Claims, 16 Drawing Sheets

Signal (Luminance)
PWM (BLU Duty)
Modulated Signal
s(t)
F
F
(Saw-tooth pulse similar to Luminance data)
p(t)
T T T T T T T T T T T T
W1 W2 W3 W4 W5 W1 W2 W3 W4 W5
Non-periodic PWM is divided into Periodic PWM signals
m(t)
FT
Frequency Mag./Phase
p1(t)
p2(t)
p3(t)
p4(t)
p5(t)
5T
D1
D2
D3
D4
D5
W1
W2
W3
W4
W5
PWMs are periodic signals (different Duties and Delays)
m1(t)
m2(t)
m3(t)
m4(t)
m5(t)
FT1
FT2
FT3
FT4
FT5

<Normal Driving Mode BLU PWM>

<Low-Speed Driving Mode BLU PWM - EX1>

<Low-Speed Driving Mode BLU PWM - EX2>

<Low-Speed Driving Mode BLU PWM - EX3>

BACKLIGHT UNIT AND DISPLAY DEVICE

CROSS REFERENCE TO RELATED APPLICATION

This application claims priority from Korean Patent Application No. 10-2018-0169352, filed on Dec. 26, 2018, which is hereby incorporated by reference for all purposes as if fully set forth herein.

BACKGROUND

Technical Field

Embodiments relate to a backlight unit and a display device.

Discussion of the Related Art

With the development of the information society, there has been increasing demand for a variety of image display devices. In this regard, a range of display devices, such as liquid crystal display (LCD) devices and organic light-emitting diode (OLED) display devices, have recently come into widespread use.

Such display devices include a display panel, in which a plurality of subpixels are arrayed. An image can be displayed by controlling levels of luminance of the plurality of subpixels.

In addition, to reduce power consumption, the display device may be driven in a low-speed driving mode, depending on an image displayed thereon. For example, the display device may be driven in the low-speed mode in an always on display (AoD) mode in which specific information is only disposed on a portion of the area of the display panel.

As the display device is driven at a low display driving frequency, the length of a data retaining period may be increased in a one-frame period. Thus, a degree by which luminance is reduced may be increased in the one-frame period. In addition, due to increases in deviations in luminance among frames, flicker may be observed. Accordingly, there may be a number of difficulties in realization of the low-speed driving mode.

SUMMARY

Accordingly, embodiments of the present disclosure are directed to a backlight unit and a display device that substantially obviate one or more of the problems due to limitations and disadvantages of the related art.

An aspect of the present disclosure is to provide a display device able to prevent flicker from occurring in an image displayed on a display panel while the display device is being driven in a low-speed driving mode.

An aspect of the present disclosure is to provide a backlight unit and a driving method thereof able to prevent flicker from occurring in a low-speed driving mode.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described, a display device may comprise: a display panel; a backlight unit including a plurality of light sources to supply light to the display panel; and a driver circuit driving the plurality of light sources. During a period in which the display panel is driven in a low driving mode, the driver circuit may output at least one first light source driving signal and at least one second light source driving signal in a one-frame period. At least one of a frequency, a duty, an amplitude, or combinations thereof, of the first light source driving signal, may be different from that of the second light source driving signal.

In another aspect, a display device may comprise: a display panel; a backlight unit supplying light to the display panel; and a plurality of light sources provided in the backlight unit. A driving frequency, a ratio of emission time, a level of emission luminance, and emission start timing of at least one light source among the plurality of light sources may be constant in a first driving mode. At least one of the driving frequency, the ratio of emission time, the level of emission luminance, and the emission start timing, or combinations thereof, may be variable in a second driving mode.

In another aspect, a backlight unit may comprise a plurality of light sources. A driving frequency, a ratio of emission time, a level of emission luminance, and emission start timing of at least one light source among the plurality of light sources may be constant in a first driving mode. At least one of the driving frequency, the ratio of emission time, the level of emission luminance, and the emission start timing, or combinations thereof, may be variable in a second driving mode According to exemplary embodiments, a light source driving signal for driving light sources of a backlight unit is variable in a low-speed driving mode, so that a frequency component causing flicker to be observed, among frequency components of luminance appearing in a one-frame period, can be reduced.

Accordingly, it is possible to prevent flicker from being visible in the low-speed mode, and reduce power consumption by driving in the low-speed mode, thereby improving the efficiency of the display device.

It is to be understood that both the foregoing general description and the following detailed description are exemplary and explanatory and are intended to provide further explanation of the inventive concepts as claimed.

DESCRIPTION OF DRAWINGS

The accompanying drawings, which are included to provide a further understanding of the disclosure and are incorporated in and constitute a part of this application, illustrate embodiments of the disclosure and together with the description serve to explain various principles. In the drawings.

DETAILED DESCRIPTION

Figure 1:
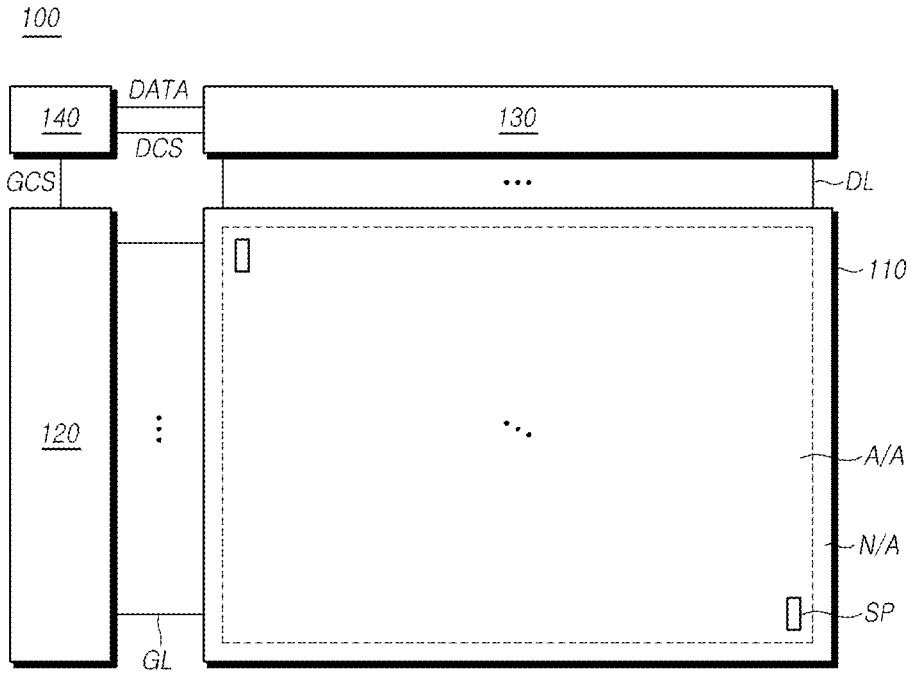
FIG. 1 illustrates a schematic configuration of a display device according to embodiments.

Hereinafter, some embodiments of the present disclosure will be described in detail with reference to the accompanying illustrative drawings. In designating elements of the drawings by reference numerals, the same elements will be designated by the same reference numerals although they are shown in different drawings. Further, in the following description of the present disclosure, a detailed description of known functions and configurations incorporated herein will be omitted in the situation in which the subject matter of the present disclosure may be rendered rather unclear thereby.

In addition, terms, such as first, second, A, B, (a), (b) or the like may be used herein when describing components of the present disclosure. Each of these terminologies is not used to define an essence, order or sequence of a corresponding component but used merely to distinguish the corresponding component from other component(s). In the case that it is described that a certain structural element "is connected to", "is coupled to", or "is in contact with" another structural element, it should be interpreted that another structural element may "be connected to", "be coupled to", or "be in contact with" the structural elements as well as that the certain structural element is directly connected to or is in direct contact with another structural element.

FIG. 1 illustrates a schematic configuration of a display device 100 according to embodiments.

Referring to FIG. 1, the display device 100 according to embodiments may include a display panel 110 comprised of an active area A/A and a non-active area N/A, as well as components for driving the display panel 110, such as a gate driver circuit 120, a data driver circuit 130, and a controller 140.

In the display panel 110, a plurality of gate lines GL and a plurality of data lines DL are disposed, and a plurality of subpixels SP are arrayed in areas in which the gate lines GL cross the data lines DL.

The gate driver circuit 120 is controlled by the controller 140, and controls the driving timing of the plurality of subpixels SP by sequentially outputting a scan signal to the plurality of gate lines GL disposed in the display panel 110.

The gate driver circuit 120 may include one or more gate driver integrated circuits (GDICs), and may be disposed on one or both sides of the display panel 110 depending on the driving system.

Each of the GDICs may be connected to a bonding pad of the display panel 110 by a tape-automated bonding (TAB) method or a chip-on-glass (COG) method, may be directly mounted on the display panel 110, or in some cases, may be integrated with the display panel 110. In addition, each of the GDICs may be implemented using a chip-on-film (COF) structure mounted on a film connected to the display panel 110.

The data driver circuit 130 receives image data from the controller 140, and converts the image data into an analog data voltage. In addition, the data driver circuit 130 outputs the data voltage to the data lines DL in the timing in which the scan signal is applied through the gate lines GL, so that each of the subpixels SP expresses a luminance level according to the image data.

The data driver circuit 130 may include one or more source driver integrated circuits (SDICs).

Each of the SDICs may include a shift register, a latch circuit, a digital-to-analog converter (DAC), an output buffer, etc.

Each of the SDICs may be connected to a bonding pad of the display panel 110 by a tape-automated bonding (TAB) method or a chip-on-glass (COG) method, may be directly mounted on the display panel 110, or in some cases, may be integrated with the display panel 110. In addition, each of the SDICs may be implemented using a chip-on-film (COF) structure. In this case, the SDIC may be mounted on a film connected to the display panel 110, and may be electrically connected to the display panel 110 via electrical connections on the film.

The controller 140 supplies a variety of control signals to the gate driver circuit 120 and the data driver circuit 130, and controls the operations of the gate driver circuit 120 and the data driver circuit 130.

The controller 140 may be mounted on a printed circuit board (PCB), a flexible PCB, or the like, and may be electrically connected to the gate driver circuit 120 and the data driver circuit 130 via the PCB, the flexible PCB, or the like.

The controller 140 controls the gate driver circuit 120 to output the scan signal in timing realized in each frame, converts image data, received from an external source, into a data signal format readable by the data driver circuit 130, and outputs the converted image data to the data driver circuit 130.

The controller 140 receives a variety of timing signals, including a vertical synchronization signal VSYNC, a horizontal synchronization signal HSYNC, an input data enable signal DE, a clock signal CLK, and the like, from an external source (e.g. a host system).

The controller 140 can generate a variety of control signals using the variety of timing signals received from the external source, and output the variety of control signals to the gate driver circuit 120 and the data driver circuit 130.

For example, the controller 140 outputs a variety of gate control signals GCS, including a gate start pulse signal GSP, a gate shift clock signal GSC, a gate output enable signal GOE, and the like, to control the gate driver circuit 120.

Here, the gate start pulse signal is used to control the operation start timing of one or more GDICs of the gate driver circuit 120. The gate shift clock signal GSC is a clock signal commonly input to the one or more GDICs to control the shift timing of the scan signal. The gate output enable signal GOE designates timing information of the one or more GDICs.

In addition, the controller 140 outputs a variety of data control signals DCS, including a source start pulse signal SSP, a source sampling clock signal SSC, a source output enable signal SOE, and the like, to control the data driver circuit 130.

Here, the source start pulse signal SSP is used to control the data sampling start timing of one or more SDICs of the data driver circuit 130. The source sampling clock signal SSC is a clock signal controlling the sampling timing of data in each of the SDICs. The source output enable signal SOE controls the output timing of the data driver circuit 130.

The touch display device 100 may further include a power management IC supplying various forms of voltage or current to the display panel 110, the gate driver circuit 120, the data driver circuit 130, and the like, or controls various forms of voltage or current to be supplied to the same.

The plurality of subpixels SP are defined by crossing of the gate lines GL and the data lines DL. Liquid crystal cells or light-emitting elements may be disposed in the subpixels SP, depending on the type of the touch display device 100.

For example, in a case in which the display device 100 is a liquid crystal display (LCD) device, a light source device, such as a backlight unit, illuminating the display panel 110, is provided, and liquid crystal cells are disposed in the subpixels SP thereof. In addition, the LCD display device 100 can express levels of luminance and display an image depending on image data by adjusting the alignment of liquid crystal cells using electromagnetic fields generated in response to the data voltage applied to the subpixels SP.

Here, the backlight unit may be disposed below the display panel 110 to supply light to the display panel 110. The backlight unit is driven by a pulse-width modulated (PWM) signal to reduce power consumption, so that light sources provided in the backlight unit may be repeatedly turned on or off at regular intervals.

In addition, the display device 100 may be driven in a normal mode and a low-speed mode to reduce power consumption thereof.

Figure 2A:
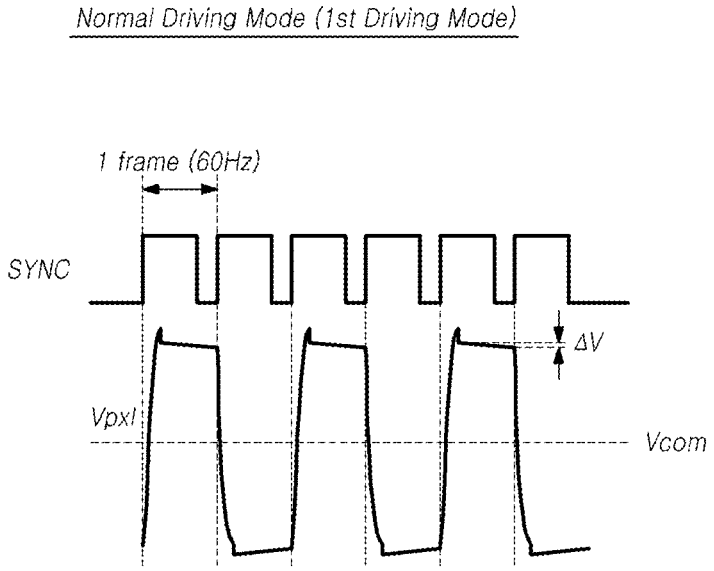
FIGS. 2A and 2B illustrate examples of changes in luminance in a normal driving mode and a low-speed driving mode of the display device according to embodiments.
Figure 2B:
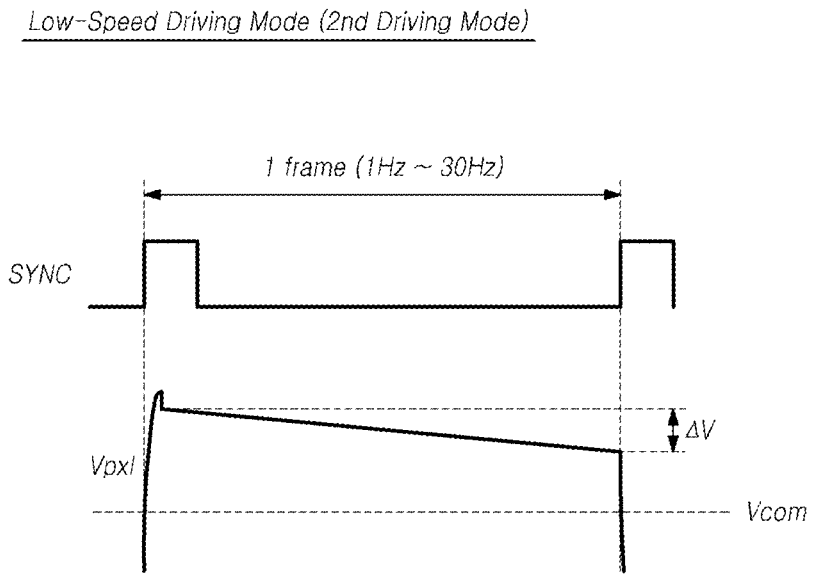

FIGS. 2A and 2B illustrate examples of changes in luminance in a normal driving mode and a low-speed driving mode of the display device 100 according to embodiments.

Referring to FIG. 2A, the display device 100 may be driven at a display driving frequency of, for example, 60 Hz, in the normal mode (or a first driving mode). Thus, during a frame period corresponding to 60 Hz according to a synchronization signal SYNC of 60 Hz, a data voltage Vdata can be supplied to each of the subpixels SP disposed in the display panel 110.

Here, a case in which the polarity of the data voltage Vdata is reversed in every frame in order to prevent liquid crystal cells from deteriorating due to offsetting of liquid crystal cells is illustrated in FIG. 2A.

In addition, each of the subpixels SP expresses a luminance level corresponding to a difference between a pixel voltage Vpxl according to the data voltage Vdata and a voltage of a common electrode Vcom, so that that the display panel 110 can display an image.

Here, although the pixel voltage Vpxl applied to the pixel electrode may be reduced during a one-frame period, a reduction in luminance due to the reduced pixel voltage Vpxl may not be observed, due to the short frame period.

In contrast, in a case in which the display device 100 is driven in the low-speed driving mode, the reduction of luminance may be observed, due to the increased one-frame period.

Referring to FIG. 2*b*, the display device 100 may be driven at a display driving frequency in the range of, for example, 1 Hz to 30 Hz, in the low-speed driving mode (or a second driving mode). Thus, the data voltage Vdata may be supplied to each of the subpixels SP during a frame period corresponding to the frequency from 1 Hz to 30 Hz.

Since the one-frame period is increased in the low-speed driving mode, the degree by which the pixel voltage Vpxl is reduced may be increased in the one-frame period.

Accordingly, the reduction of luminance due to the reduced pixel voltage Vpxl may be increased. Due to deviations in luminance between frames, caused by the reduced luminance, flicker may be observed in the low-speed driving mode.

In addition, in luminance expressed by an image in which flicker is observed in the low-speed driving mode, a specific frequency component may have a significant amplitude.

That is, although flicker may appear to be observable in the low-speed driving mode as luminance is reduced during the one-frame period, flicker may also be observed depending on the frequency components of luminance appearing during the one-frame period.

Embodiments propose a method able to prevent flicker from being visible in the low-speed driving mode by frequency component analysis of luminance appearing during a one-frame period in the low-speed driving mode.

Figure 3:
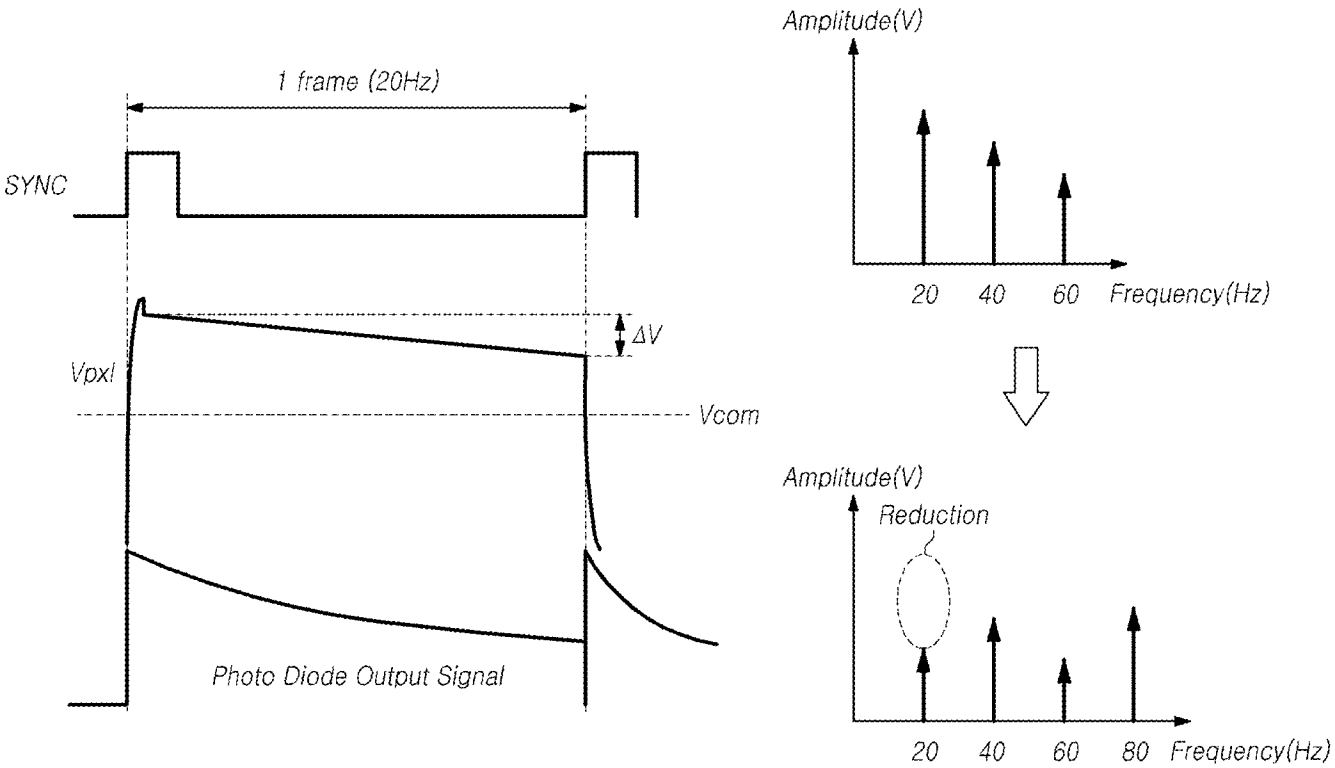
FIGS. 3 and 4 illustrate an example of a method of reducing flicker by performing frequency component analysis on luminance appearing in a one-frame period of the low-speed driving mode in the display device according to embodiments.
Figure 4:
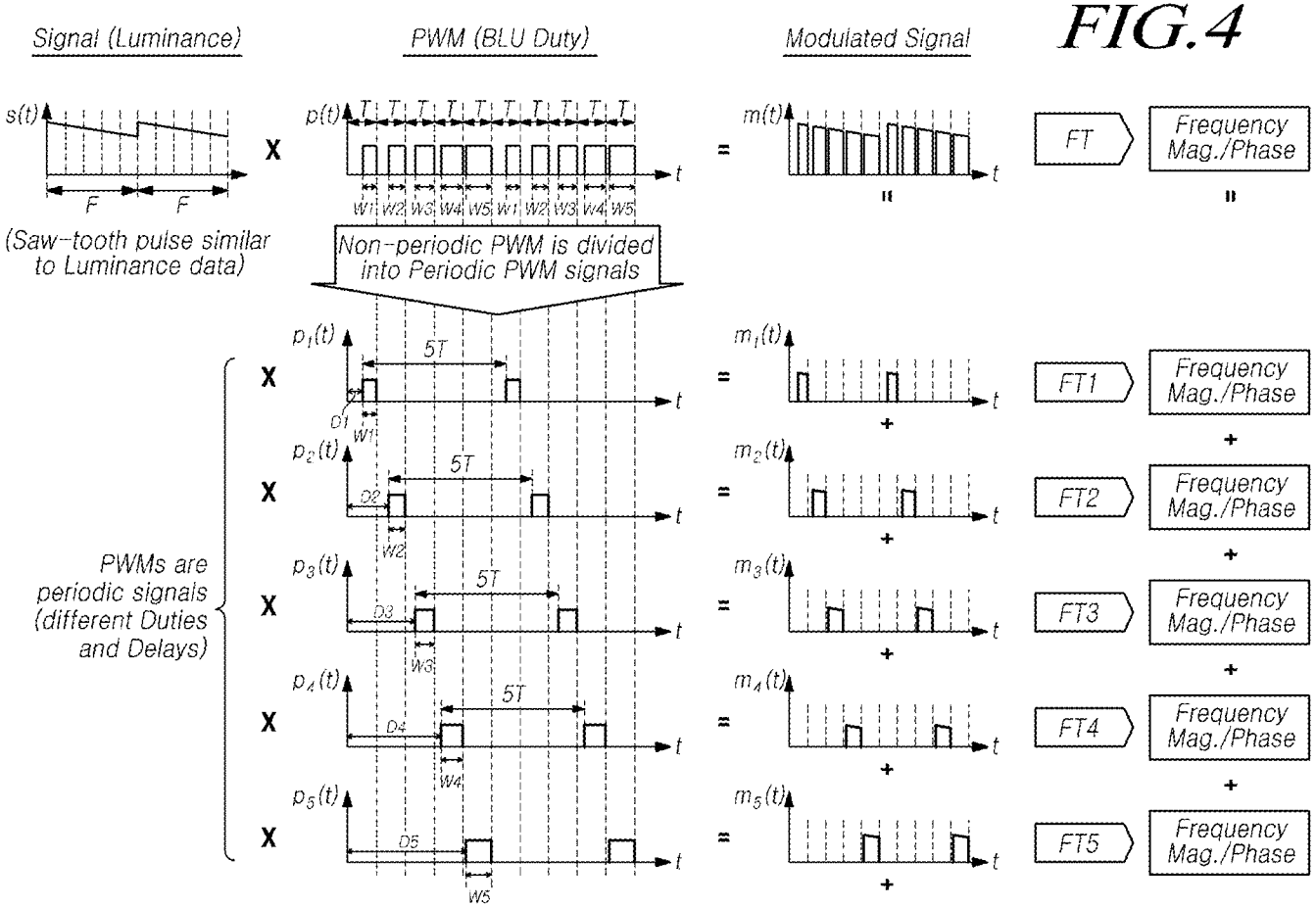

FIGS. 3 and 4 illustrate an example of a method of reducing flicker by performing frequency component analysis on luminance appearing in a one-frame period of the low-speed driving mode in the display device 100 according to embodiments.

Referring to FIG. 3, the display device 100 can be driven at a display driving frequency, e.g. 20 Hz, in the low-speed driving mode. Thus, the one-frame period may be longer than a frame period of the normal driving mode, thereby increasing the degree by which luminance is reduced during the one-frame period.

Here, when luminance appearing in the one-frame period in the low-speed driving mode is analyzed by performing frequency component analysis on an output signal measured using a photodiode, frequency components may appear in specific bandwidths, e.g. 20 Hz, 40 Hz, and 60 Hz. In particular, the frequency component appearing in 20 Hz bandwidth, i.e. a display driving frequency bandwidth, has the highest amplitude.

Here, when a backlight driving signal for supplying light to the display panel 110, i.e. a signal for on-off controlling of a light source of the backlight unit, is adjusted, a frequency component of 20 Hz bandwidth, among frequency components of luminance appearing in the one-frame period, can be reduced.

For example, frequency components of luminance appearing in a one-frame period can be adjusted by varying at least one of a frequency, a duty (or a pulse width), an amplitude, a delay time, or combinations thereof, of the backlight driving signal during the corresponding frame period.

That is, it is possible to change frequency components of luminance produced by the display panel 110 in the low-speed driving mode by varying at least one of a driving frequency, a ratio of emission time, a level of emission luminance, emission start timing, or combinations thereof, of the light source of the backlight unit in the low-speed driving mode.

Described in detail with reference to FIG. 4, a modulated signal, i.e. a luminance waveform appearing in response to the backlight driving signal, can be obtained, on the basis of a sawtooth pulse or waveform similar to luminance appearing in the frame period of the low-speed driving mode and the backlight driving signal.

Here, the backlight driving signal may be an aperiodic signal having different duties. The backlight driving signal can be divided into signals having the same cycles. Then, on the basis of the divided backlight driving signal and the waveform similar to luminance appearing in the frame period of the low-speed driving mode, the modulated signal according to the divided backlight driving signal can be obtained.

Such modulated signals can be subjected to Fourier transform, thereby producing frequency components having different amplitudes and periods.

That is, since the driving signal of the backlight unit have different delay times D1, D2, D3, D4, and D5 or different duties W1, W2, W3, W4, and W5, different frequency components of luminance can be caused by the driving signal of the backlight unit.

In addition, when the modulated signals having different frequency components are combined, a specific frequency component can be canceled.

Accordingly, it is possible to adjust frequency components of luminance appearing during a one-frame period of the low-power mode by varying the duty or the like of the backlight driving signal during the one-frame period.

In addition, since it is possible to vary the backlight driving signal so that a specific frequency component is reduced, the specific component can be avoided in luminance appearing in the low-speed driving mode. Accordingly, flicker according to the specific frequency component can be prevented from being visible.

That is, it is possible to adjust frequency components of luminance appearing in the one-frame period of the low-speed driving mode by varying at least one of the frequency, duty, amplitude, delay time, or combinations thereof, of the driving signal supplied to the light source of the backlight frame during the one-frame period of the low-speed driving mode.

FIGS. 5A to 5D illustrate examples of the backlight driving signal in a normal mode and a low-speed driving mode of the display device 100 according to embodiments.

Figure 5A:
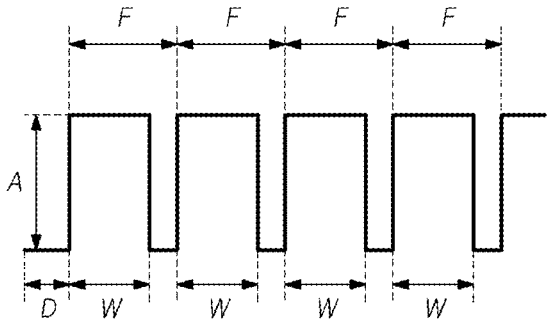
FIGS. 5A to 5D illustrate examples of the backlight driving signal in a normal mode and a low-speed driving mode of the display device according to embodiments.

Referring to FIG. 5A, in the normal driving mode, all of the frequency W, duty W, amplitude A, and delay time D of the backlight driving signal can be constant or uniform. In the normal driving mode, the frequency of the backlight driving signal may be in a kHz bandwidth.

That is, in the normal driving mode, the light source of the backlight unit can be turned on and off in the same cycles during a one-frame period. In addition, in each of the cycles, the ratio of emission time can be constant, and the level of emission luminance can be constant. In addition, emission start timing in each of frame periods can be constant.

As described above, in the normal driving mode, the backlight driving signal is applied uniformly, so that the light source of the backlight unit can be periodically driven to express a constant level of luminance. That is, in the normal driving mode, the duty of the backlight driving signal can be determined to be constant in order to reduce power consumption or adjust overall levels of luminance.

Figure 5B:
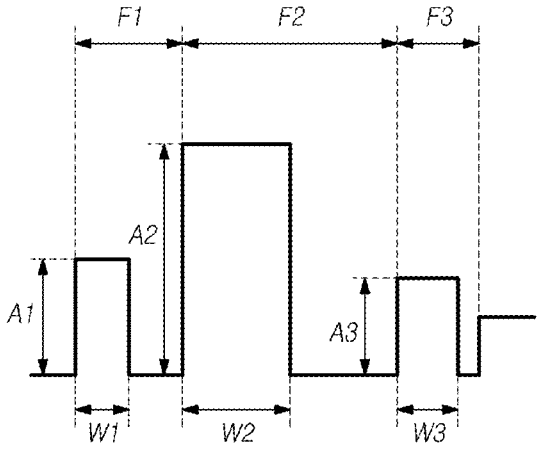

In addition, referring to FIG. 5B, in the low-speed driving mode, at least one of a frequency, a duty, an amplitude, or combinations thereof, of the backlight driving signal, can be varied in a one-frame period.

For example, in a first subframe (or section) period of the one-frame period, the backlight driving signal may have a frequency F1, a pulse width W1, and an amplitude A1.

In addition, in a second subframe (or section) period, the backlight driving signal may have a frequency F2, a pulse width W2, and an amplitude A2. The driving signal, supplied in the second subframe period, may differ from the driving signal supplied in the first subframe period.

In addition, a frequency F3, a pulse width W3, and an amplitude A3 of the driving signal, supplied in a third subframe period, may differ from those of the driving signal supplied in either the first subframe period or the second subframe period.

In addition, as illustrated in FIG. 5B, the delay time in each of the frame periods before the supply of the driving signal can be varied.

That is, the delay time D1 in the first frame period may differ from the delay time D2 in the second frame period.

Figure 5C:
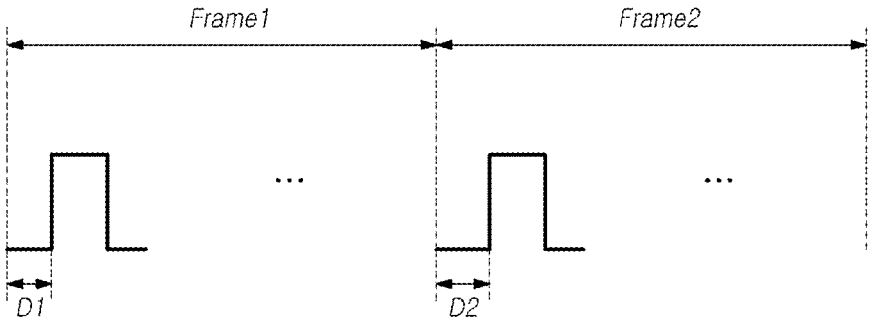
Figure 5D:
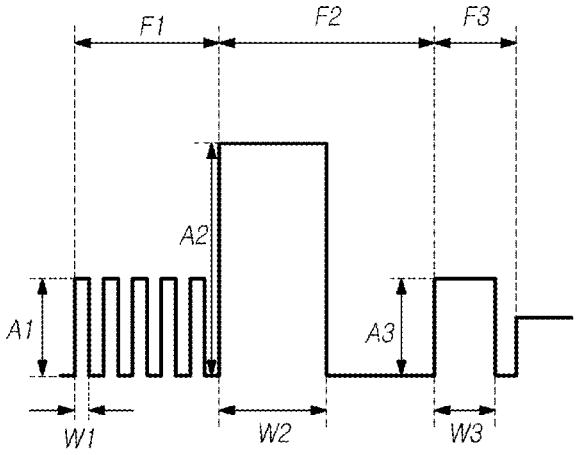

Alternatively, as illustrated in FIG. 5C, a plurality of driving signal having the same frequency, duty, and amplitude can be applied in some of the subframe periods of the one-frame period, as required.

Accordingly, the driving signal may be supplied different number of times according to the subframe periods.

Here, in the low-speed driving mode, the frequency of the backlight driving signal may be in a Hz bandwidth. That is, the frequency of the backlight driving signal in the low-speed driving mode may be lower than the frequency of the backlight driving signal in the normal driving mode.

In the low-speed driving mode, the backlight driving signal may be varied to be supplied in every subframe period of the one-frame period by a variety of methods in addition to the above-described examples. Accordingly, the driving frequency, ratio of emission time, level of emission luminance, and the like, of the light source of the backlight unit may be different according to the subframe periods. In addition, emission start timing may be different according to the frame periods.

Since the duty of the driving signal is variable whenever supplied in the subframe periods, luminance can have different frequency components according to the first subframe period, the second subframe period, and the third subframe period, in which the luminance appears. In addition, the driving signal can be supplied such that a frequency component causing flicker to be observed, among frequency components in luminance appearing in each of the subframe periods, is canceled.

As described above, the frequency component analysis, performed on luminance appearing during the one-frame period in the low-speed driving mode, can vary the backlight driving signal so that a frequency component causing flicker to be visible can be reduced. Accordingly, this can prevent or reduce flicker from being visible in the low-speed driving mode.

In addition, since flicker is not visible in the low-speed driving mode, it is possible to reduce power consumption using the low-speed driving mode and drive the display device 100 at a lower display driving frequency, thereby improving the efficiency of the display device 100.

Figure 6:
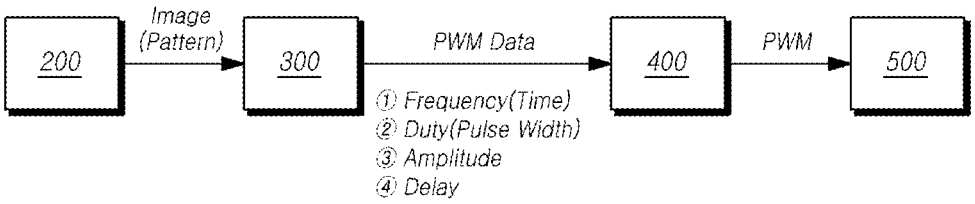
FIG. 6 illustrates an example of a configuration of generating and outputting the backlight driving signal in the display device according to embodiments.

FIG. 6 illustrates an example of a configuration of generating and outputting the backlight driving signal in the display device according to embodiments.

Referring to FIG. 6, a calculation circuit 300 receives image data Image (Pattern) from a host system 200.

The calculation circuit 300 generates light source control data PWM Data to control the driving of the backlight unit, on the basis of at least one of the image data received from the host system 200, a display driving frequency of the low-speed driving mode, or a combination thereof.

The light source control data PWM Data may include, for example, a frequency (or a subframe period), a duty (or a pulse width), an amplitude, and a delay time of the backlight driving signal.

For example, the calculation circuit 300 can generate and output the light source control data PWM Data by referring to a look-up table in which the driving frequency of the low-speed driving mode or the light source control data PWM Data according to the image data is stored.

The calculation circuit 300 may be the controller 140 of the display device 100, may be provided in the form of a chip within the controller 140, or may be a micro controller unit MCU provided separately from the controller 140, by way of example.

The light source control data PWM Data, generated by the calculation circuit 300, is transmitted to a driver circuit 400.

The driver circuit 400 outputs a light source driving signal PWM to drive the light source 500 of the backlight unit, on the basis of the light source control data PWM Data received from the calculation circuit 300.

The light source driving signal PWM may be a signal, the frequency, duty, amplitude, and delay time of which are determined according to the light source control data PWM Data.

That is, a light source driving signal PWM, of which at least one of the frequency, the duty, the amplitude, or combinations thereof, is variable, can be output by the driver circuit 400 in the one-frame period. In addition, the light source driving signal PWM having different delay times according to the frame periods may be output.

The driver circuit 400 may be a light source integrated circuit (IC, e.g. LED IC) for driving the light source 500, a power management integrated circuit (PMIC), or a pulse-width modulation integrated circuit (PWM IC). In addition, the driver circuit 400 may be connected to a printed circuit of the backlight unit or may be disposed in a printed circuit connected to the display panel 110.

As described above, due to the calculation circuit 300 and the driver circuit 400, the light source driving signal PWM for driving the light source 500 of the backlight unit in the low-speed driving mode can be applied in a varied state during a one-frame period.

Accordingly, in the low-speed driving mode, the driving frequency, the ratio of emission time, the level of emission luminance, the emission start timing, and the like, of the light source 500 can be varied, so that a frequency component causing flicker to be observed can be avoided from frequency components of luminance appearing in the low-speed driving mode. Accordingly, this can prevent or reduce flicker in the low-speed driving mode.

FIGS. 7 to 10 illustrate examples of the backlight driving signal in a case in which the backlight unit according to embodiments is an edge-lit backlight unit.

Figure 7:
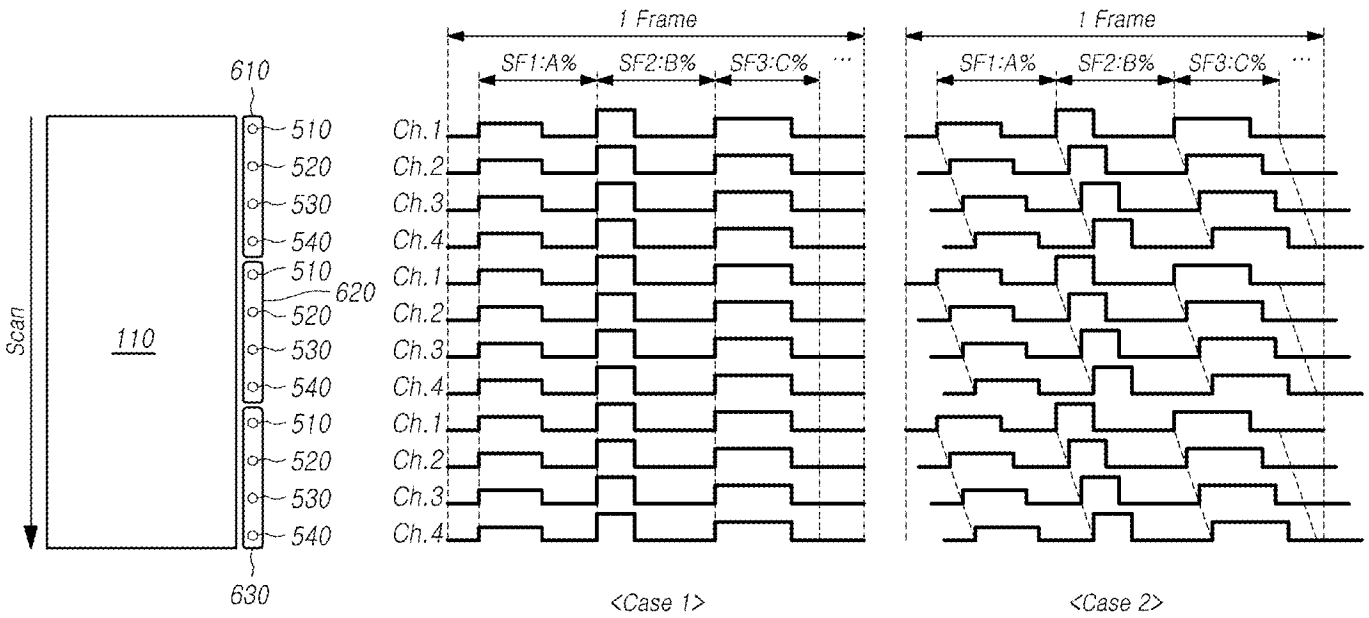
FIGS. 7 to 10 illustrate examples of the backlight driving signal in a case in which the backlight unit according to embodiments is an edge-lit backlight unit.
Figure 8:
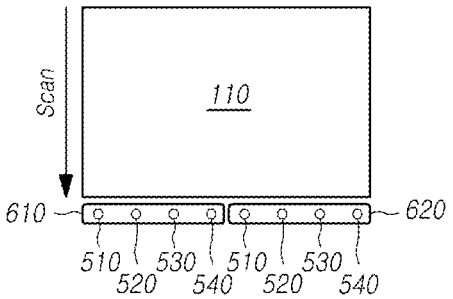
Figure 8:
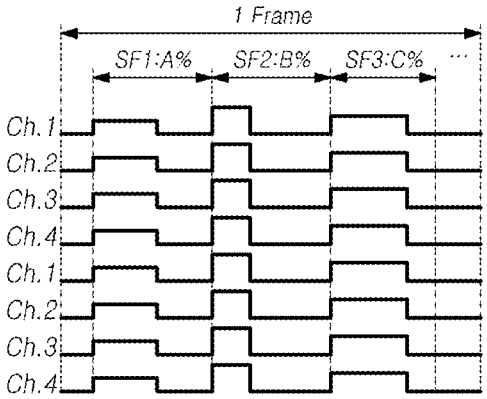

Referring to FIGS. 7 and 8, a number of light sources 500 may be disposed on at least one side surface of the backlight unit. FIG. 7 illustrates an example in which the light sources 500 are arranged in a direction the same as a direction of scanning of the display panel 110, while FIG. 8 illustrates an example in which the light sources 500 are arranged in a direction intersecting the direction of scanning of the display panel 110.

The light sources 500 may be grouped into light source arrays 610, 620, and 630, each of which is comprised of a plurality of light sources 500.

For example, a first light source 510, a second light source 520, a third light source 530, and a fourth light source 540 may be disposed in each of the light source arrays 610, 620, and 630.

In addition, the first light source 510 can be driven by the light source driving signal PWM supplied through a first channel, while the second light source 520, the third light source 530, and the fourth light source 540 can be driven by the light source driving signal PWM supplied through a second channel, a third channel, and a fourth channel, respectively.

In the light source driving signal PWM supplied through each of the channels in the low-speed driving mode, at least one of a frequency, a duty, an amplitude, a delay time, or combinations thereof, can be varied.

That is, in the one-frame period, the length of the subframe in which the light source driving signal PWM is applied, the ratio of the period in the subframe, in which the light source 500 is turned on, or the voltage level, at which the light source 500 is turned on, can be varied. In addition, a point in time in the frame period, at which the light source 500 starts to emit light, can be varied.

For example, as in Case 1 and Case 2, the duty of the light source driving signal PWM in a first subframe SF1 may be A %. In addition, in a second subframe SF2 and a third subframe SF3, the duties of the light source driving signal PWM may be B % and Co, respectively.

In addition, the light source driving signal PWM may have different amplitudes in the subframes, respectively.

Although each of the subframes is illustrated as having the fixed length by way of example, the length of the subframe may be varied. In addition, the delay time before the supply of the light source driving signal PWM may be different according to the subframe periods.

In addition, in a specific subframe period, the light source driving signal PWM having the same duty and the same amplitude may be supplied a plurality of times.

In the edge-lit backlight unit, the channels may simultaneously supply the light source driving signal PWM as in Case 1, or may sequentially supply the light source driving signal PWM as in Case 2.

As described above, the duty, amplitude, and the like, of the light source driving signal PWM, supplied in the subframe periods of the one-frame period in the low-speed driving mode, are adjusted. This can cancel the frequency component causing flicker to occur, so that no flicker may be visible in the low-speed driving mode.

In addition, although the light sources 500 driven through the respective channels may be arranged in the light source arrays 610, 620, and 630, respectively, as in the foregoing example, the light sources 500 arranged in the same light source array 610, 620, or 630 may be driven through the same channel.

Figure 9:
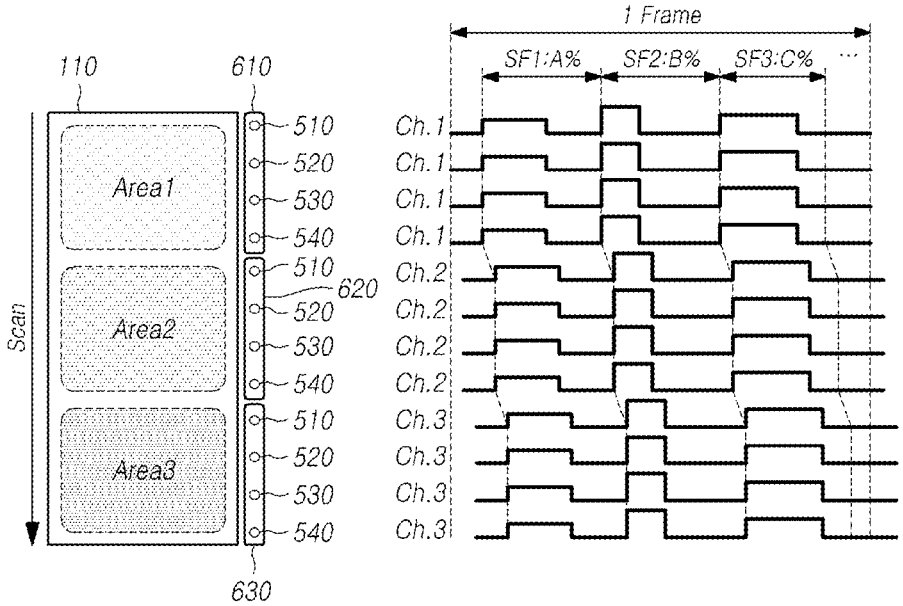
Figure 10:
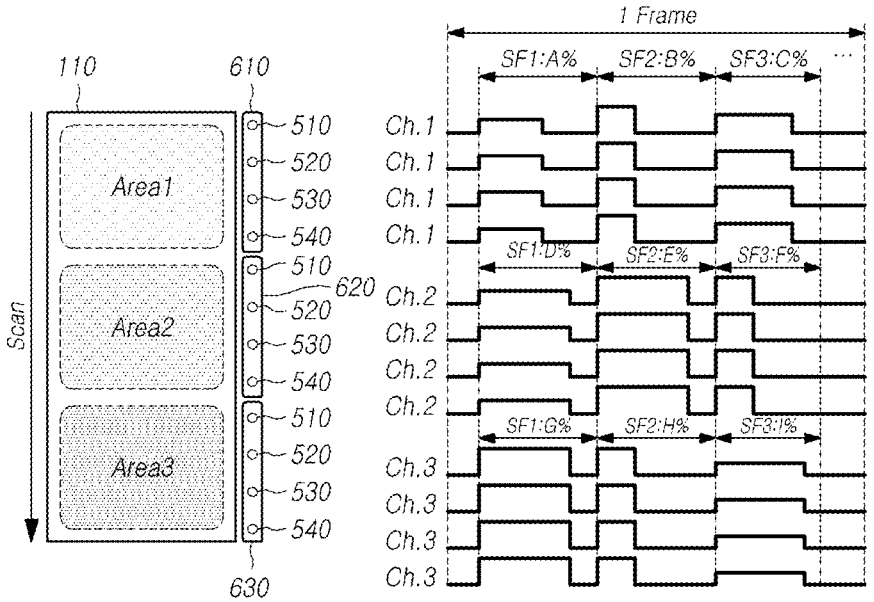

Referring to FIGS. 9 and 10, the first light source 510, the second light source 520, the third light source 530, and the fourth light source 540, arranged in the light source array 610, can be driven by the light source driving signal PWM supplied through the first channel. In addition, the light sources 500 arranged in the light source arrays 620 and 630 can be driven by the light source driving signal PWM supplied through the second channel and the third channel, respectively.

In addition, the channels may supply the light source driving signal PWM in the same timing or may sequentially supply the light source driving signal PWM in shifted timing.

That is, although flicker may be created depending on the display driving frequency of the low-speed driving mode, flicker may be visible depending on the image displayed by the display panel 110.

Accordingly, the light sources 500 emitting light to a first area Area1 can be driven through the first channel while the light sources 500 emitting light to second and third areas Area2 and Area3 can be driven through the second and third channels, respectively, so that the light source driving signal PWM can be easily adjusted according to the input image. Here, the first area Area1, the second area Area2, and the third area Area3, to which light is emitted from one or more light sources 500, may be configured to have different numbers, sizes, and shapes, according to information regarding the input image. For example, in a case in which light having an input image divided into five areas should be controlled according to the respective areas, the area to which light is emitted from one or more light sources 500 can be set to be five areas having different sizes. In addition, the areas, such as the first area Area1, the second area Area2, and the third area Area3, to which light is emitted from one or more light sources 500, may be set to be fixed or different in every frame or predetermined frames of the display. For example, in a case in which the input image is an image without a change for 30 frames, the set area can be set to be fixed without a change for 30 frames. In addition, in a case in which the input image is an image that changes by at least a predetermined reference level in every 10 frames, the set area can be changed for every 10th frame.

The light source driving signal PWM supplied through the respective channels can be independently varied. For example, as illustrated in FIG. 10, the duty of the light source driving signal PWM supplied through the first channel can be varied to be A %, B %, and Co, and the duty of the light source driving signal PWM supplied through the second channel can be varied to be D %, E %, and F %. In addition, the duty of the light source driving signal PWM supplied through the third channel can be varied to be G %, H %, and I %.

In addition, the light source driving signal PWM supplied through the respective channels may have different amplitudes according to the corresponding subframe periods. The corresponding subframe periods may have different lengths.

As described above, the adjacent light sources 500 can be driven through the same channel, and the light source driving signal PWM can have different duties, amplitudes, and the like, according to the channels, through which the light source driving signal PWM is supplied. Accordingly, it is possible to improve the ability to prevent or reduce flicker by adjusting the light source driving signal PWM in the edge-lit backlight unit. Accordingly, it is possible to prevent or reduce flicker in the edge-lit backlight unit by adjusting the light source driving signal PWM.

In addition, in some cases, the channels through which the light sources 500 of the edge-lit backlight unit are controlled can be independently driven, so that the light source driving signal PWM for preventing or reducing flicker can be more easily adjusted.

Figure 11:
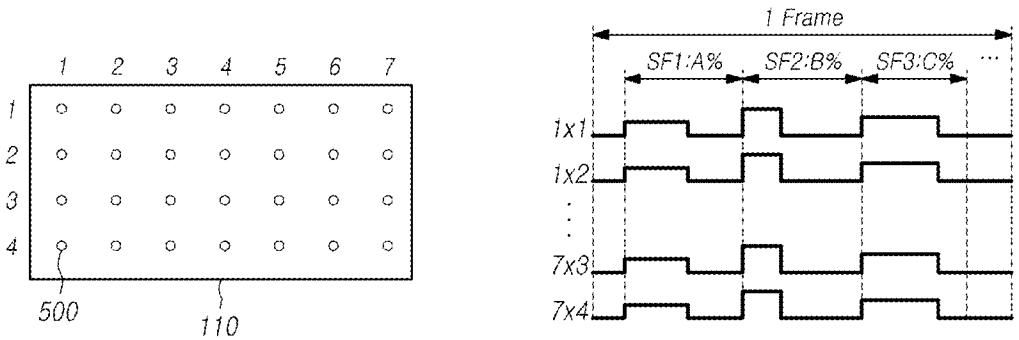
FIGS. 11 and 12 illustrate an example of the backlight driving signal in a case in which the backlight unit according to embodiments is a direct-lit backlight unit.
Figure 12:
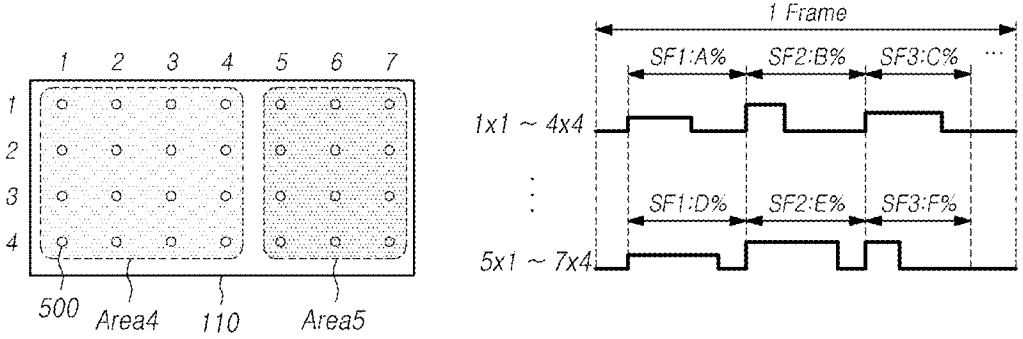

FIGS. 11 and 12 illustrate an example of the backlight driving signal in a case in which the backlight unit according to embodiments is a direct-lit backlight unit.

Referring to FIG. 11, a number of light sources 500 may be disposed on one surface of the backlight unit facing the display panel 110. That is, the light sources 500 can supply light to the display panel 110 in a direction perpendicular to the display panel 110.

While the display device 100 is being driven in the low-speed driving mode, the light source driving signal PWM, of which at least one of the frequency, the duty, the amplitude, or combinations thereof, is variable, can be output during the one-frame period.

For example, as illustrated in FIG. 11, the light source driving signal PWM having a duty A % can be supplied in the first subframe SF1, while the light source driving signal PWM having a duty B % and the light source driving signal PWM having a duty Co can be supplied in the second subframe SF2 and the third subframe SF3, respectively.

In addition, the amplitude of the light source driving signal PWM, supplied in each of the subframe periods, can be varied.

In some cases, the length of the subframe period can be varied, or the delay time before the supply of the light source driving signal PWM, in each of the frame periods, can be varied.

Here, since the light sources 500 of the direct-lit backlight unit are disposed on the surface facing the display panel 110, some of the light sources 500, disposed in a specific area, can be driven by the same light source driving signal PWM, depending on the image pattern.

For example, as illustrated in FIG. 12, light sources 500 disposed in a fourth area Area4 can be driven by the light source driving signal PWM having duties A %, B %, and Co in respective subframes. In addition, light sources 500 disposed in a fifth area Area5 can be driven by the light source driving signal PWM having duties D %, E %, and F % in respective subframes. Here, areas, such as the fourth area Area4 and the fifth area Area5, to which light is emitted from one or more light sources 500, may be configured to have different numbers, sizes, and shapes, according to information regarding an input image. For example, in a case in which light having an input image divided into five areas should be controlled according to the respective areas, the area to which light is emitted from one or more light sources 500 can be set to be five areas having different sizes. In addition, the areas, such as the fourth area Area4 and the fifth area Area5, to which light is emitted from one or more light sources 500, may be set to be fixed or different in every frame or predetermined frames of the display. For example, in a case in which the input image is an image without a change for 30 frames, the set area can be set to be fixed without a change for 30 frames. In addition, in a case in which the input image is an image that changes by at least a predetermined reference level in every 10 frames, the set area can be changed for every 10th frame.

As set forth above, the light source driving signal PWM for driving the light sources 500 to emit in respective areas can be independently controlled. Accordingly, it is possible to easily adjust the light source driving signal PWM in order to cancel a frequency component causing flicker to be visible, according to the image pattern displayed in the low-speed driving mode.

In addition, since the respective light sources 500 in the direct-lit backlight unit can be driven independently, the control operation for avoiding a frequency component causing flicker to be visible can be easily performed by adjusting at least one of the frequency, duty, amplitude, delay time, or combinations thereof, of the light source driving signal (PWM).

According to embodiments of the present disclosure as set forth above, it is possible to reduce a frequency component that causes flicker, among frequency components of luminance occurring during a frame period, by varying and supplying the backlight driving signal in the low-speed mode of the display device 100.

The frequency component causing flicker to be visible can be reduced, thereby preventing flicker from being visible in the low-speed mode.

Accordingly, the display device 100 can be driven in the low-speed driving mode to reduce power consumption.

In addition, since flicker may be prevented by frequency component analysis, the display device 100 can be driven at a lower display driving frequency, the frame length of which is longer, so that the driving efficiency of the display device 100 can be improved.

It will be apparent to those skilled in the art that various modifications and variations can be made in the backlight unit and the display device of the present disclosure without departing from the technical idea or scope of the disclosure. Thus, it is intended that the present disclosure cover the modifications and variations of this disclosure provided they come within the scope of the appended claims and their equivalents.

What is claimed is:

1. A display device, comprising:

a display panel;

a backlight unit including a plurality of light sources configured to supply light to the display panel, the plurality of light sources including:

a first light source; and a second light source; and a driver circuit configured to:

output a light source driving signal; and drive the plurality of light sources, wherein, during a period in which the display panel is driven in a normal driving mode, the drive circuit is further configured to output the light source driving signal, a frequency, a duty, and an amplitude of which are constant, in a one-frame period, wherein, during a period in which the display panel is driven in a low-speed driving mode, the driver circuit is further configured to output at least one first light source driving signal and at least one second light source driving signal in the one-frame period, wherein at least one of a frequency, a duty, an amplitude, or combinations thereof, of the at least one first light source driving signal, is different from that of the at least one second light source driving signal, wherein, in the normal driving mode, the at least one first light source is configured to receive a same light source driving signal as a light source driving signal that the at least one second light source receives, and wherein, in the low-speed driving mode, the first light source is further configured to receive a light source driving signal that is different from the light source driving signal that the second light source receives.

2. The display device according to claim 1, wherein:

the at least one first light source driving signal is output in a first subframe period of the one-frame period; and the at least one second light source driving signal is output in a second subframe period of the one-frame period.

3. The display device according to claim 1, wherein:

the at least one first light source driving signal is output to the first light source; and the at least one second light source driving signal is output to the second light source in a period corresponding to a subframe period in which the at least one first light source driving signal is output to the first light source.

4. The display device according to claim 1, wherein at least one of the at least one first light source driving signal, the at least one second light source driving signal, or a combination thereof, is supplied a plurality of times to at least one subframe period among a plurality of subframe periods of the one-frame period.

5. The display device according to claim 1, wherein a delay time of the at least one light source driving signal output in a first frame period is different from a delay time of the light source driving signal output in a second frame period.

6. The display device according to claim 1, wherein:

the plurality of light sources are disposed on at least one side surface among side surfaces of the backlight unit; and the at least one first light source driving signal and the second at least one light source driving signal are output through different channels or, in different subframe periods, through a single channel.

7. The display device according to claim 1, wherein:

the plurality of light sources are disposed on a surface of the backlight unit facing the display panel; and the at least one first light source driving signal and the at least one second light source driving signal are output to light sources disposed in different areas, among the plurality of light sources, or in different subframe period, to light sources disposed in a single area, among the plurality of light sources.

8. The display device according to claim 1, further comprising a controller transmitting light source control data to the driver circuit, the controller being configured to transmit different light source control data according to at least one of: a driving frequency of the low-speed driving mode, image data input to the controller, and a combination thereof.

9. A display device, comprising:

a display panel;

a backlight unit supplying light to the display panel; and a plurality of light sources provided in the backlight unit, the plurality of light sources including:

a first light source; and a second light source, wherein a driving frequency, a ratio of emission time, a level of emission luminance, and emission start timing of at least one light source among the plurality of light sources are constant in a first driving mode, wherein at least one of the driving frequency, the ratio of emission time, the level of emission luminance, and the emission start timing, or combinations thereof, is variable in a second driving mode, wherein, in the first driving mode, the driving frequency, the ratio of emission time, the level of emission luminance, and the emission start timing of the first light source are equal to those of the second light source, and wherein, in the second driving mode, at least one of the driving frequency, the ratio of emission time, the level of emission luminance, the emission start timing, and combinations thereof, of the first light source, is different from that of the second light source.

10. The display device according to claim 9, wherein, in the second driving mode, at least one light source among the plurality of light sources is repeatedly turned on and off a plurality of times in at least one driving period among driving periods according to the driving frequency.

11. The display device according to claim 9, wherein the driving frequency of the light source in the first driving mode is higher than the driving frequency of the light source in the second driving mode.

12. A backlight unit, comprising:

a plurality of light sources, the plurality of light sources including:

a first light source; and a second light source, wherein a driving frequency, a ratio of emission time, a level of emission luminance, and emission start timing of at least one light source among the plurality of light sources are constant in a first driving mode, wherein at least one of the driving frequency, the ratio of emission time, the level of emission luminance, and the emission start timing, or combinations thereof, is variable in a second driving mode, wherein, in the first driving mode, the driving frequency, the ratio of emission time, the level of emission luminance, and the emission start timing of the first light source are equal to those of the second light source, and wherein, in the second driving mode, at least one of the driving frequency, the ratio of emission time, the level of emission luminance, the emission start timing, and combinations thereof, of the first light source, is different from that of the second light source.

* * * * *